United States Patent [19]

Strickland

[11] 3,988,799

[45] Nov. 2, 1976

[54] BODY SCRUBBING APPARATUS

[76] Inventor: Hubert E. Strickland, 1417 Perry St., Chesapeake, Va. 23324

[22] Filed: Feb. 27, 1975

[21] Appl. No.: 553,470

[52] U.S. Cl. ..... 15/97 R; 15/28

[51] Int. Cl.[2] ..... A47K 7/04; A46B 13/02

[58] Field of Search ..... 15/23, 24, 28, 29, 22 R, 15/97 R; 128/56

[56] References Cited

UNITED STATES PATENTS

| | | | |
|---|---|---|---|
| 1,555,522 | 9/1925 | Shapiro | 15/23 |
| 1,891,470 | 12/1932 | Errington et al. | 15/23 |
| 2,026,981 | 1/1936 | Kahnt | 15/22 R |
| 2,904,804 | 9/1959 | Odessey | 15/23 X |
| 3,114,924 | 12/1963 | Morrison | 15/97 R |
| 3,715,770 | 2/1973 | Gomez | 15/28 |

FOREIGN PATENTS OR APPLICATIONS

| | | | |
|---|---|---|---|
| 1,175,530 | 11/1958 | France | 15/28 |
| 1,239,435 | 7/1960 | France | 15/28 |

*Primary Examiner*—Edward J. Roberts
*Attorney, Agent, or Firm*—J. Maxwell Carson, Jr.

[57] ABSTRACT

Apparatus useable by a bather for facilitating the scrubbing of the back including a wall mounted, conventionally controlled, electric motor enclosed within a substantially water tight housing; a flexible shaft component having a rotatable flexible shaft element interconnected with the shaft of such motor to be rotatably driven thereby; and a brush arm component having an elongated hand grip section, an elongated body section interconnected therewith, and a head section interconnected with such body section thereof carrying a rotatable shaft element extending therefrom perpendicularly to the longitudinal centerline of such hand grip section thereof. The flexible shaft component extending from such housing longitudinally enters the hand grip section of such brush arm component and extends longitudinally through the body section thereof towards the head section thereof, where the flexible shaft element thereof is interconnected by means of suitable gearing with the shaft element extending therefrom to rotatably drive the same. The shaft element extending from such brush arm component head section readily detachably carries a disposable scrubbing element including a disk shaped body of soft scrubbing material applicable to the body and which is rotated by the operation of such motor.

4 Claims, 6 Drawing Figures

BODY SCRUBBING APPARATUS

This invention relates generally to apparatus useable by a bather to facilitate the washing or scrubbing of the back, and more particularly to apparatus of this type including a manually manipulated scrubbing element rotatably driven by means of an elongated, flexible shaft component interconnected with an electric motor mounted on a building interior wall adjacent a bath tub, or mounted on an interior wall of a shower enclosure.

Heretofore, a person desirous of scrubbing the back while bathing in a tub partially filled with water or in a shower has usually found it to be difficult to apply the wash cloth or the like being utilized to the upper central portion thereof, and in many cases such a person who may be suffering from a disablement such as arthritis or the like may find the scrubbing of this portion of the body to be virtually impossible. Various types of devices have, accordingly, been previously proposed for the purpose of alleviating the outlined problem. Along such lines, devices such as those shown, for example, in U.S. Pat. No. 1,712,521 granted to A. Rothchild et al. on May 14, 1929; in U.S. Pat. No. 3,042,949 issued on July 10, 1962, to G. C. Mosely; and in U.S. Pat. No. 3,768,462 granted on Oct. 30, 1973, to L. Boulard, have been designed for the obviation of the difficulties of a bather hereinbefore set forth. While it appears that such prior art devices are adequately functionable for the attainment of the contemplated objectives thereof, it is nevertheless considered that a more satisfactory solution of the hereinbefore outlined problem is desirable, and consequently the present application is drawn to apparatus useable by a bather for facilitating the scrubbing of the back in which certain drawbacks of the hereinbefore mentioned prior art devices in this field are eliminated, and which provides advantages not obtainable with such prior art devices.

Accordingly, an object of the present invention is the provision of apparatus readily useable by a bather in facilitating the scrubbing of the back.

Another object of the instant invention is the provision of apparatus including a revolving scrubbing element readly and manually applicable by a bather to the upper central portion of the back.

A further object of the present invention is the provision of simple, inexpensive, and reliable apparatus operationally including an electrically driven, rotating scrubbing element readily manually applicable by a bather to the upper central portion of the back and which is readily disconnectable from the means provided for electrically driving the same after use for disposal.

According to the instant invention, the foregoing and other objects are obtained by providing, on an interior wall of a building adjacent a bath tub, or on an interior wall of a shower stall or enclosure, a suitable metallic frame assembly carrying, in a desired attitude, a conventional electric motor. A conventional switch component provided with one or more control elements of the push-button or any other desired type is also carried by such frame assembly; such switch component being electrically interconnected with a suitable source of alternating current and with such electric motor. A suitable housing is provided to enclose in a water tight manner such frame assembly, as well as the motor and the switch component carried thereby; such housing being suitably apertured to provide for the projection of such control element or elements of such switch component therethrough. An elongated, flexible shaft component including a flexible, tubular, rubber or plastic casing element having a flexible steel cable rotatably positioned therein is situated with a length thereof adjacent one of the ends thereof within such housing; such end of such flexible steel cable being interconnected with the shaft of such electric motor to be rotatably driven thereby. The other of the ends of such flexible shaft component is interconnected with a brush arm component including a hand grip section and an elongated body section; a length of such flexible shaft component entering such brush arm component at the free end of the hand grip section thereof and proceeding therefrom through the body section thereof. The brush arm component includes a head section at the terminus of the body section thereof most remote from the hand grip section thereof which carries a metallic shaft element rotatably mounted therein; the centerline of such shaft element being substantially perpendicularly positioned with respect to the hand grip section of such brush arm component. The flexible steel cable element of such flexible shaft component is interconnected, by means of suitable gearing situated within the head section of such brush arm component, with the terminus of such metallic shaft element carried by such head section of such brush arm component positioned therein; rotation of such flexible steel cable element of such flexible shaft component causing such shaft element carried by the head section of such brush arm component to rotate at the same rate. A terminal portion of such metallic shaft element carried by the head section of such brush arm component projecting outwardy therefrom is square shaped in cross-section and carries mounted thereon a spring clip utilized in detachably interconnecting an operationally rotatable scrubbing element or scrub brush with such portion of such shaft element. Such scrubbing element or scrub brush includes a substantially rigid disk element having a hub section centrally projecting from a first surface thereof; such hub section being provided with a square shaped aperture centrally projecting thereinto. The hub section of such scrubbing element or scrub brush is readily detachably interconnected with the metallic shaft element carried by the head section of the brush arm component; such square shaped portion of such shaft element being positioned within the square shaped aperture formed in such hub section of such scrubbing element or scrub brush with portions of such spring clip carried by such shaft element being engaged with cooperating recesses formed in the walls of such square shaped aperture. A scrubbing material such as cotton wool or the like in disk form is bonded to a second surface of the disk element of such scrubbing element or scrub brush opposite the first surface thereof provided with such hub section. Inasmuch as such scrubbing element or scrub brush is intended to be discarded after use, the apparatus according to the present application may include one or more multi-compartmented trays suitably suspended from such frame assembly adjacent the wall carrying the same for holding a supply of such scrubbing elements or scrub brushes each of which is individually wrapped or packaged prior to use in a waterproof manner. In use, a bather would interconnect a new scrubbing element or scrub brush with the shaft element carried by the head section of the brush arm component, and switch on such motor. Then, holding the brush arm component by the hand grip section thereof, such bather would use the rotating scrubbing element or scrub brush in the scrubbing of the back; the length of the body section of such brush arm component being sufficient to readily permit the application of such scrubbing element or scrub brush to all portions of the back. Such bather, upon completion of the bath, after having switched off such motor, would then discard such used scrubbing element or scrub brush, and then hang such brush arm component out of the way on such housing; suitable hook means or the like being provided therefor.

A more complete appreciation of the invention and many of the attendant advantages thereof will be readily apparent as the same becomes better understood by reference to the folowing detailed description when considered in connection with the accompanying drawing wherein.

Figure 6:
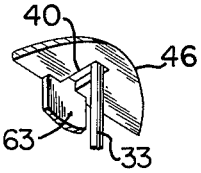
Figure 5:
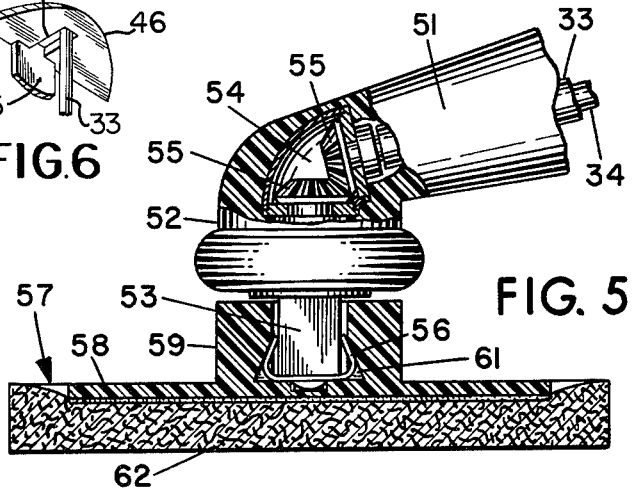

FIG. 5 is a side elevational view, partially in section, on a further enlarged scale, showing the interconnection of a scrubbing element with the shaft element carried by the head section of the brush arm component of the apparatus according to the present invention; and FIG. 6 is a fragmentary perspective view of the lower wall of the housing encompassed be the apparatus according to the instant invention showing a shaft element receiving notch provided therein.

Figure 1:
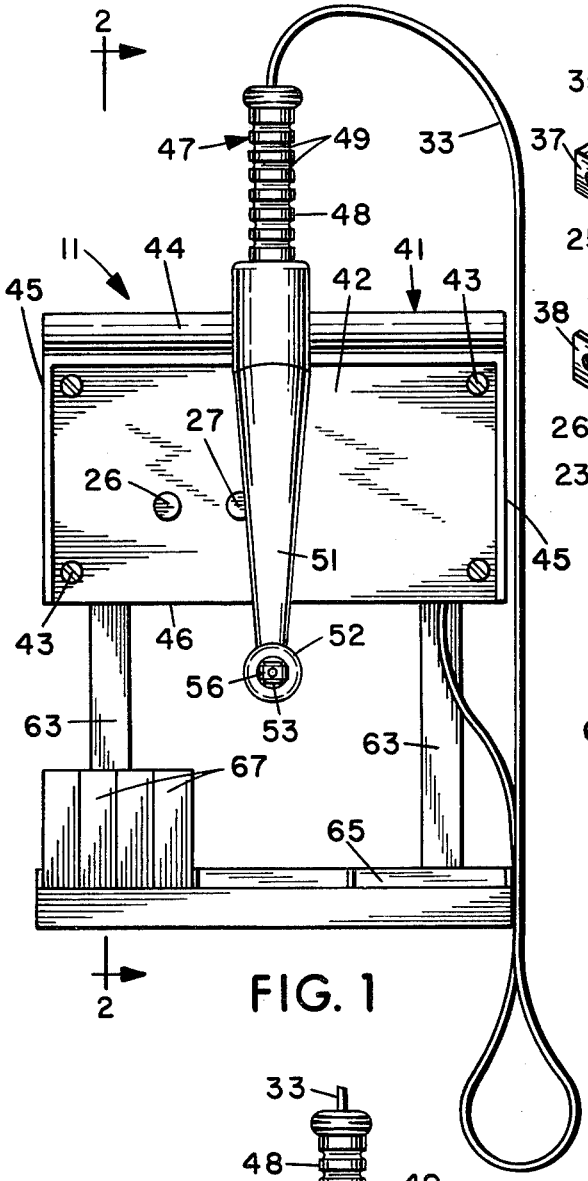
FIG. 1 is a front elevational view of the apparatus according to the instant invention.
Figure 3:
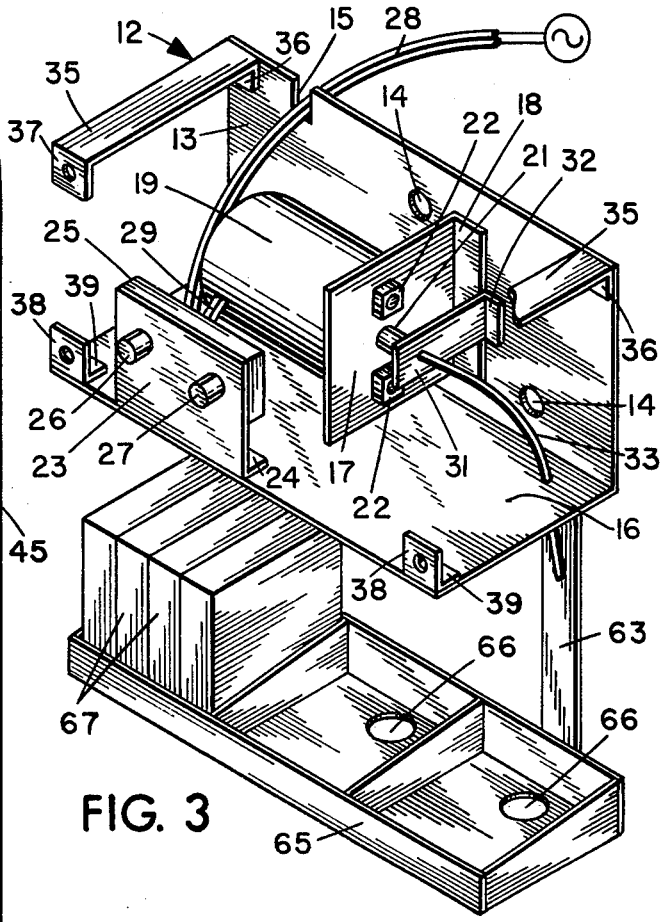
FIG. 3 is a perspective view of a portion of the apparatus according to the present invention showing the frame assembly thereof, with one part broken away, and showing a scrubbing element carrying tray suspended therefrom.
Figure 2:
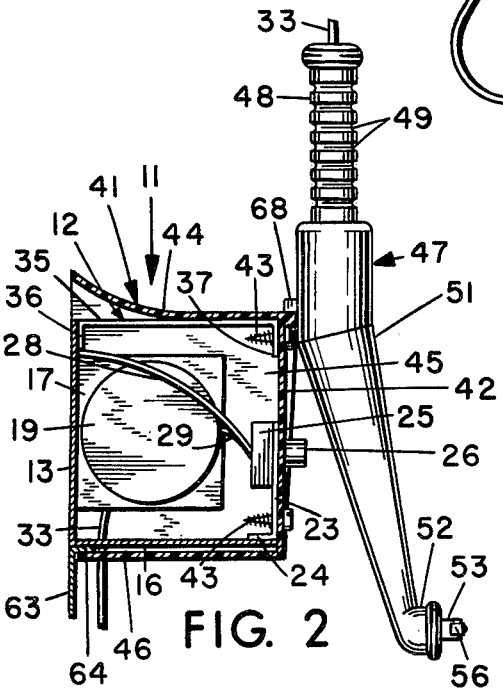
FIG. 2 is a partial, sectional, elevational view thereof, taken on the line 2 — 2 of FIG. 1.

Referring now more particularly to the drawing, wherein like reference numerals designate the same or identical parts throughout the several views, and more specifically to FIGS. 1 – 3, there is shown apparatus, generally designated by the reference numeral 11, useable by a bather to facilitate the scrubbing of the back. Apparatus 11 includes a frame assembly, generally designated by the reference numeral 12, having a rectangularly shaped base plate 13 formed of relatively thin sheet metal provided with a plurality of suitably positioned mounting holes 14 extending therethrough. The base plate 13 of frame assembly 12 is operationally positioned with one surface thereof against an interior wall of a building in a desired position adjacent a bath tub, or against an interior wall of a shower stall or enclosure in a desired position, and screws or the like, not illustrated, are then passed through such mounting holes 14 and screwed down into such wall to firmly secure the base plate 13 thereagainst. When secured to such a wall, the longer edges of such rectangular base plate 13 of frame assembly 12 are horizontally disposed to define the uppermost and lowermost extremities thereof, and a square or rectangular shaped notch 15 may be provided at the uppermost extremity thereof in a suitable location, if deemed desirable, through which electrical conductors interconnected within such wall with the electrical wiring system of the building may extend therefrom, as more fully set forth hereinafter.

Frame assembly 12 further includes a ractangularly shaped lower plate 16 of the same length as the base plate 13 integrally formed with such base plate 13 and extending substantially horizontally outwardly from such base plate 13 along the lower extremity thereof. A rectangularly shaped motor mounting plate 17 formed of relatively thin sheet metal integrally provided with a flange element 18 along one of the shorter edges thereof perpendicularly disposed with respect thereto is also included in the frame assembly 12; such flange element 18 being rigidly connected to such base plate 13 as by welding or the like at a predetermined position in such a manner that such motor mounting plate 17 extends perpendicularly outwardly from such base plate 13 over such lower plate 16 in a substantially vertical attitude. A conventional electric motor 19 of the type operable of alternating current usually provided in buildings is carried by such motor mounting plate 17 in such a manner that the longitudinal centerline thereof, as well as the centerline of the shaft element 21 thereof aligned therewith, is disposed in a substantially horizontal attitude and is substantially parallel to the surface of the adjacent wall carrying such base plate 13. The end wall of such motor 19 from which the shaft element 21 thereof extends is situated adjacent one of the substantially vertically disposed surfaces of the motor mounting plate 17; the shaft element 21 of motor 19 snugly extending through a suitable aperture provided in such motor mounting plate 17. A pair of threaded metallic studs extend outwardly from such end wall of the motor 19 in the same direction as the shaft element 21 thereof; such studs being connected as by welding or the like to such end wall of the motor 19 at diametrically opposed points with respect to the shaft element 21 thereof and substantially equidistantly therefrom. Each of such studs extends through a suitable aperture provided in the motor mounting plate 17, and a nut 22 is then turned down upon the free end of each of such threaded studs thereby rigidly interconnecting such motor 19 with such motor mounting plate 1.

Frame assembly 12 of apparatus 11 also includes a switch component mounting plate 23 interconnected with the lower plate 16 thereof. Such switch component mounting plate 23 is rectangularly shaped and is formed of relatively thin sheet metal. Such switch component mounting plate 23 is provided with a flange element 24 integrally connected therewith along one of the longer edges thereof and perpendicularly disposed with respect thereto; such flange element 24 being rigidly connected as by welding or the like to the upper surface of the lower plate 16 of frame assembly 12 in such a manner that the surface of such switch component mounting plate 23 most remote from the base plate 13 of frame assembly 12 extends substantially vertically upwardy from such lower plate 16 at the edge thereof most remote from such base plate 13. A conventional switch component 25 is suitably connected to an upper portion of the surface of the switch component mounting plate 23 nearest the base plate 13 of frame assembly 12; such switch component 25 having control elements 26 and 27 projecting outwardly therefrom and extending through suitable apertures formed through such switch component mounting plate 23. The control element 26 may be a switch element of the push-button type manually operable to switch the motor 19 on and off, and the control element 27 may be any suitable and conventional device operable in a desired manner to vary the operating speed of such motor 19. As mentioned hereinbefore, an electrical cable 28 including a pair of electrical conductors interconected with the alternating current electrical system of the building may extend from the wall thereof carrying the base plate 13 of frame assembly 12 through the notch 15 formed therein for interconnection with such switch component 25, and another electrical cable 29 including a pair of electrical conductors electrically interconnects such switch component 25 and such electric motor 19; such control elements 26 and 27 of switch component 25 being operable, as indicated hereinbefore, to control the flow of alternating current entering such switch component 25 through cable 28 and then passing therefrom to the motor 19 through the cable 29.

The frame assembly 12 of apparatus 11 also includes a rigid and rectangularly shaped flexible shaft mounting plate 31 formed of relatively thin sheet metal provided with a flange element 32 extending along one of the shorter edges thereof and perpendicularly disposed with thereto; such flange element 32 being rigidly connected as by welding or the like to the base plate 13 of frame assembly 12 adjacent the flange element 18 of motor mounting plate 17 in such a manner that such flexible shaft mounting plate 31 extends outwardly from such base plate 13 parallelly to the motor mounting plate 17 at a small distance from the free end of the shaft element 21 of motor 19. An aperture is provided through such flexible shaft mounting plate 31 in alignment with the centerline of such shaft element 21 of motor 19, and a small length of an elongated, flexible shaft component 33 having a flexible shaft element 34 formed of steel cable rotatably positioned within a flexible, tubular casing element formed of hard rubber or a plastic material extends snugly through such aperture provided in the flexible shaft mounting plate 33 towards such shaft element 21 of the motor 19. Such flexible shaft component 33 is suitably immovably secured within such aperture provided in the flexible shaft mounting plate 31, and the flexible shaft element 34 thereof is suitably interconnected with the shaft element 21 of motor 19 in such a manner that rotation of such shaft element 21 of motor 19 will cause the entire length of such flexible shaft element 34 of such flexible shaft component 33 to rotate at the same rate within such flexible casing element enclosing the same. The flexible shaft component 33 curves away and downwardly from such flexible shaft mounting plate 31 and passes snugly through an aperture formed in the lower plate 16 of frame assembly 12 at a point near one of the shorter end edges thereof and near the base plate 13 of frame assembly 12.

The frame assembly 12 of apparatus 11 further includes a pair of elongated, rectangularly shaped, upper housing mounting elements 35 formed of relatively thin sheet metal each projecting substantially horizontally outwardly from the base plate 13 at the upper edge thereof adjacent one of the ends thereof; each of such elements 35 having a downwardly extending flange element 36 integrally formed therewith at one of the shorter edges thereof and perpendicularly disposed with respect thereto rigidly connected as by welding or the like to such base plate 13, as well as with a similar downwardly extending flange element 37 integrally formed therewith at the other of the shorter edges thereof. Each of such flange elements 37 is provided with an aperture substantially centrally formed therethrough, and the surface thereof most remote from the base plate 13 of frame assembly 12 lies substantially in the vertical plane in which the edge of the lower plate 16 of frame assembly 12 most remote from the base plate 13 thereof is disposed. It will be noted that one of such pair of upper housing mounting elements 35 has been partially broken away in FIG. 3 of the drawing in the interest of more clearly showing other elements of frame assembly 12 therein, but such upper housing mounting element 35 is shown in its entirety in FIG. 2 of the drawing. Likewise, the frame assembly 12 includes a pair of substantially square shaped lower housing mounting elements 38 formed of relatively thin sheet metal each projecting substantially vertically upwardly from the lower plate 16 of frame assembly 12 adjacent one of the end edges thereof. Each of such elements 38 is provided with a flange element 39 formed integrally therewith at the lowermost edge thereof and perpendicularly disposed with respect thereto rigidly connected as by welding or the like to the upper surface of the lower plate 16 of frame assembly 12 in such a manner that the surface of each of such elements 38 most remote from the base plate 13 of frame assembly 12 lies substantially in the vertical plane in which the edge of the lower plate 16 of frame assembly 12 most remote from the base plate 13 thereof is disposed. Each of such lower housing mounting elements 38 is provided with an aperture substantially centrally formed therethrough similar to the apertures formed through the flange element 37 of each of the upper housing mounting elements 35. The aperture formed through each of such lower housing mounting elements 38 is preferably situated directly beneath the aperture formed through the flange element 37 of an upper housing mounting element 35.

Apparatus 11 also includes a housing, generally designated by the reference numeral 41, formed of a suitable molded plastic material or the like, provided with a rectangularly shaped front wall 42 having an inner surface positionable against the surface of the flange element 37 of each of the upper housing mounting elements 35 of frame assembly 12 most remote from the base plate 13 thereof, and also positionable against the corresponding surface of each of the lower housing mounting elements 38 of frame assembly 12. Such front wall 42 of the housing 41 is provided with an aperture formed therethrough adjacent each of the four corners thereof each operationally alignable with the aperture formed through the flange element 37 of an upper housing mounting element 35 or with the aperture formed through a lower housing mounting element 38, and is further provided with a suitable aperture formed therethrough correspondingly alignable with each of the control elements 26 and 27 of the switch component 25. The housing 41 may be positioned with the apertures formed through the front wall 42 thereof aligned as hereinbefore set forth, at which time the control elements 26 and 27 of switch component 25 will extend substantially snugly through the apertures provided therefor in such front wall 42 of the housing 41, and a self-tapping screw 43 is then inserted through each of such apertures provided in such front wall 42 of housing 41 adjacent each of the four corners thereof and then screwed into the aligned aperture provided in the flange element 37 of an upper housing mounting element 35 or in a lower housing mounting element 38, cutting threads therein in the process, to rigidly operationally interconnect such housing 41 with the frame assembly 12 of apparatus 11.

The housing 41 of apparatus 11 further includes an upper wall 44 having a front edge spaced from the wall carrying the frame assembly 12 somewhat overhanging the front or exterior surface of the front wall 42 of housing 41; such overhanging portion of such upper wall 44 of housing 41 being centrally provided with a vertically extending slot formed therethrough for the purpose hereinafter set forth. Such upper wall 44 of housing 41 proceeds substantially horizontally inwardy from such front edge thereof directly above the upper housing mounting elements 35 of frame assembly 12 towards the wall carrying the same to about the longitudinal midpoints of such upper housing mounting elements 35, and then curves somewhat upwardly and away therefrom; such upper wall 44 of housing 41 having a rear edge operationally firmly contacting the wall carrying the frame assembly 12 along a line elevated above the upper edge of the base plate 13 thereof. It will be obvious that the described configuration of the upper wall 44 of housing 41 will cause any water deposited thereon to flow away from the rear edge thereof operationally positioned against such wall carrying the frame assembly 12 in the interest of preventing such water from penetrating the line of juncture between such edge of the housing upper wall 44 and the wall carrying such frame assembly 12.

The front wall 42 of housing 41 has a horizontally disposed lower edge operationally maintained at a level somewhat beneath the lower surface of the lower plate 16 of frame assembly 12. Such housing 41 further includes end walls 45 having lower edges operationally maintained in the horizontal plane occupied by the lower edge of the front wall 42 thereof; such end walls 45 of housing 41 extending upwardly from such lower edges thereof towards the end edges of such housing upper wall 44 and being integrally interconnected therewith. Each of the end walls 45 of housing 41 extends from an end edge of the front wall 42 thereof, with which it is integrally interconnected along the length thereof, towards the wall carrying the frame assembly 12 of apparatus 11; each of such housing end walls 45 having a vertically disposed rear edge operationally firmly contacting such wall carrying the frame assembly 12 of apparatus 11. Such housing 41 of apparatus 11 further includes a lower wall 46 having a front edge integrally interconnected along the length thereof with the lower edge of the front wall 42 thereof, and having end edges integrally interconnected along the lengths thereof with the lower edges of the end walls 45 thereof; such housing lower wall 46 having a rear edge operationally firmly contacting the wall carrying the frame assembly 12 of apparatus 11. The upper surface of the housing lower wall 46 is operationally spaced somewhat beneath the lower surface of the lower plate 16 of frame assembly 12 of apparatus 11, for the purpose set forth hereinafter, and the rear edge of such housing lower wall 46 is provided with a suitable notch 40 formed therein extending forwardly towards the front edge thereof operationally receiving the flexible shaft component 33 extending downwardly from the lower plate 16 of the frame assembly 12 when such housing 41 is operationally interconnected with such frame assembly 12 of apparatus 11 as hereinbefore set forth. The rear edge of the housing lower wall 46 is further slightly notched along two short portions of the length thereof equidistantly spaced from the ends thereof for the purpose also set forth hereinafter. It will be apparent that, if deemed desirable, suitable sealing means may be interposed between the edges of the walls of such housing 41 operationally contacting the wall carrying the frame assembly 12 of apparatus 11 and such wall carrying such frame assembly 12 of apparatus 11 in the interest of more securely sealing the interior of such housing 41 against the intrusion thereinto of water or water vapor.

Apparatus 11 further includes a brush arm component, generally designated by the reference numeral 47, formed of a suitable molded plastic, having a cylindrically shaped, elongated hand grip section 48 which may be rendered more firmly manually graspable as by, for example, the provision of a plurality of longitudinally spaced, circumferential grooves 49 formed therein. The brush arm component 47 of apparatus 11 further includes an elongated body section 51 having a substantially cylindrically shaped first portion of the length thereof in longitudinal alignment with and integrally connected to such hand grip section 48 thereof; such brush arm component body section 51 further having a second portion of the length thereof disposed at an angle of about 20° to 25° with respect to such first portion of the length thereof. Such second portion of the length of such brush arm component body section 51 is of somewhat frusto-conical form, tapering smoothly down in diameter from the diameter of such first portion of the length thereof, with which it is integrally connected, towards a head section 52 of such brush arm component 47 which in turn is integrally connected therewith. The brush arm component head section 52 is essentially cylindrical in configuration, although the end thereof interconnected with the body section 51 of brush arm component 47 may be rounded off, as indicated in the drawing, and the longitudinal centerline thereof is disposed substantially perpendicularly to an outward extension of the centerline of the hand grip section 48 and such first portion of the length of the body section 51 of the brush arm component 47. The longitudinal centerlines of the hand grip section 48, both portions of the length of body section 51, and the head section 52 of brush arm component 47 all lie in the same plane. An elongated metallic shaft element 53 is rotatably carried by the brush arm component head section 52; the longitudinal centerline of such shaft element 53 coinciding with the longitudinal centerline of such head section 52 of brush arm component 47. A length of such shaft element 53 extending outwardly from such brush arm component head section 52 is square shaped in cross-section. As shown in FIG. 5 of the drawing, a suitable gear box 54 is provided in such brush arm component head section 52, and a pair of intermeshing and similar bevel gears 55 are suitably rotatably mounted therein; a first of such bevel gears 55 having its axis of rotation in alignment with the centerline of the flexible shaft component 33 extending theretowards through the body section 51 of brush arm component 47 and being suitably connected to the flexible shaft element 34 thereof to be rotatably driven thereby. The second of such bevel gears 55 has its axis of rotation in alignment with the centerline of the shaft element 53 carried by the brush arm component head section 52, and is suitably interconnected thereto to rotatably drive the same. It will now be seen that operation of the electric motor 19 causes the shaft element 21 thereof to rotate the flexible shaft element 34 of flexible shaft component 33 at the same rate, in turn causing rotation of the intermeshing bevel gears 55 at the same rate, thereby rotatably driving the shaft element 53 carried by the brush arm component head section 52 at a corresponding rate. A spring clip element 56 formed of resilient sheet steel is suitably secured to the free end of the length of such shaft element 53 extending from the brush arm component head section 52; such clip element having a central portion extending across such end of such shaft element 53, and further having a pair of end portions each curving from an end of such central portion thereof towards a point on diametrically opposed sides of such shaft element 53 at about the longitudinal midpoint of the length thereof extending outwardly from such brush arm component head section 52.

Figure 4:
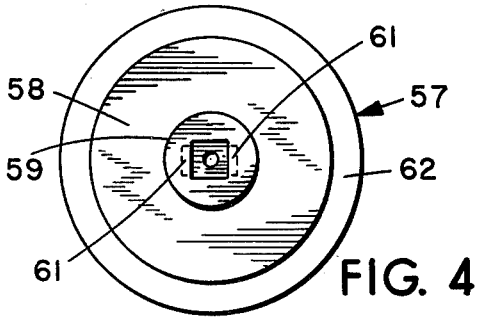
FIG. 4 is a plan view, on an enlarged scale, of a scrubbing element operationally encompassed by the apparatus according to the instant invention.

Referring now to both FIGS. 4 and 5 of the drawing, it will be seen that apparatus 11 operationally includes a scrubbing element, generally designated by the reference numeral 57, including a substantially rigid disk element 58 formed of a suitable molded plastic material having a cylindrically shaped hub section 59 integrally and centrally projecting from a first surface thereof. A square shaped aperture centrally extends downwardly into such hub section 59 of scrubbing element 57 from the free end thereof; such aperture having side walls somewhat greater in width than the width of the flat sides of that portion of the length of the shaft element 53 extending outwardly from the brush arm component head section 52. A suitable recess 61 is provided in two of the diametrically opposed side walls of the aperture formed in the hub section 59 of scrubbing element 57 adjacent the deepest portion thereof. The portion of the shaft element 53 extending from the brush arm component head section 52 may be substantially entirely positioned within such aperture formed in the hub section 59 of scrubbing element 57, at which time the end portions of the spring clip element 56 carried thereby are in alignment with such recesses 61. As such portion of such shaft element 53 enters such aperture provided in such hub section 59 of scrubbing element 57, such end portions of such spring clip element 56 are flattened thereagainst, but when such shaft element 53 is fully positioned within such aperture such end portions of the spring clip element 56 spring out unto such recesses 61, thereby readily detachably interengaging such shaft element 53 and such scrubbing element 57, as clearly shown in FIG. 5 of the drawing. Such scrubbing element 57, further includes a disk shaped body of scrubbing material 62 symetrically adhesively bonded to the second of the surfaces of the disk element 58 thereof; such body of scrubbing material 62 being formed of a soft substance such as, for example, cotton wool, and being greater in diameter than such disk element 58 of scrubbing element 57.

Apparatus 11 may further include a pair of elongated, rectangularly shaped support elements 63 formed of relatively thin sheet metal each having a flange element 64 integrally interconnected with one of the shorter edges thereof and perpendicularly disposed with respect thereto. Each of such flange elements 64 is rigidly connected as by welding or the like to the lower surface of the lower plate 16 of frame assembly 12 of apparatus 11 in such a manner that such support elements 63 extend downwardly therefrom with a flat surface thereof adjacent the wall carrying the frame assembly 12 of apparatus 11; such support elements 63 being equidistantly spaced from the ends of such lower plate 16 of such frame assembly 12. As mentioned hereinbefore, the further slight notches formed in the rear edge of the housing lower wall 46 are provided to receive such support elements 63 situated as described when the housing 41 is operationally interconnected with the frame assembly 12 of apparatus 11, as set forth hereinbefore, and the hereinbefore mentioned spacing between the lower surface of the lower plate 16 of such frame assembly 12 and the upper surface of such housing lower wall 46 permits the flange elements 64 of each of the support elements 63 to extend therebetween. A metallic, multi-compartmented tray 65 provided with a weep hole 66 formed through the lower wall of each of the compartments thereof is rigidly interconnected with the lower extremities of such support elements 63 as by welding or the like, and a plurality of waterproof packages 67 each containing a disposable scrubbing element 57 may be disposed in each of such compartments of such tray 65. Of course, if desired, such support elements 63 may be further extended downwardly, and one or more additional trays 65 may also be similarly interconnected therewith.

As mentioned hereinbefore, a bather using the apparatus 11 according to the present invention would first select one of the packages 67 and withdraw therefrom the scrubbing element 57 contained therein. Such scrubbing element 57 would then be interengaged with the shaft element 53 extending from the brush arm component head section 52, as hereinbefore set forth, and the body of scrubbing material 62 moistened and soap rubbed thereinto. At the desired time, such bather would switch on the motor 19 and, holding the brush arm component 47 by the hand grip section 48 thereof, apply the rotating body of wet and soaped scrubbing material 62 to any portion of the back without undue difficulty. Upon completion of the bath, such bather would switch off the motor 19, remove the used scrubbing element 57 from engagement with the shaft element 53, and discard the same.

When not in use such brush arm component 47 of apparatus 11 may be hung out of the way by engaging a suitable hook element 68 provided thereon with the slot centrally provided in the portion of the housing upper wall element 44 overhanging the exterior surface of the housing front wall 42.

It is presently contemplated that apparatus according to the present invention may be installed in motel and hotel rooms for the use of guests therein. In such an event, it will be apparent that the motor 19 thereof could be controlled by a conventional coin operated device useable when a coin is fed thereinto to switch such motor 19 on and upon the expiration of a predetermined time period to automatically switch such motor 19 off again, in lieu of the controls therefor hereinbefore described.

It is further presently contemplated that a householder owning apparatus according to the present invention and using the same at home may desire to make use of a scrubbing element 57 on more than one occasion. In such an event, the body of scrubbing material 62 carried thereby as hereinbefore described could be replaced by a more durable substance such as, for example, sponge rubber.

Obviously, many modifications and variations of the present invention are possible in the light of the foregoing teachings. It is therefore to be understood that within the scope of the appended claims the invention may be practiced otherwise than as specifically described.

What is claimed as new and desired to be protected by Letters Patent of the United States is:

1. Apparatus useable by a bather for facilitating the scrubbing of the back, comprising:

a frame assembly connected to a wall partially enclosing an area adapted to be utilized by a person for the bathing of the body, said frame assembly carrying an electric motor as well as means for controlling the operation of said motor, said frame assembly further carrying means for the mounting of a housing thereon;

a substantially water tight housing interconnected with said means for the mounting of a housing carried by said frame assembly, said housing having an upper wall overlying said frame assembly and a lower wall underlying said frame assembly, said housing further having a first end wall disposed adjacent a first end of said frame assembly and a second end wall disposed adjacent a second end of said frame assembly, said housing upper, lower, and end walls each having an edge substantially abutting said wall carrying said frame assembly for substantially preventing the passage of water from the exterior to the interior of said housing along said edges of said housing walls, said housing further having a front wall integrally interconnected with said upper, lower, and end walls thereof in a plane remote from said wall carrying said frame assembly, said front wall of said housing having at least one aperture formed therethrough, said means for controlling said electric motor carried by said frame assembly including at least one control element extending substantially snugly through said aperture provided in said housing front wall for manual manipulation exteriorly of said housing;

a flexible shaft element connected to the shaft element of said electric motor and extending outwardly from said housing through a notch extending from the edge of a wall thereof substantially abutting said wall carrying said frame assembly towards said front wall of said housing;

a brush arm component having a hand grip section, an elongated body section, and a head section; a terminal length of said flexible shaft element most remote from said motor entering the free end of said brush arm component hand grip section and proceeding therethrough towards said head section thereof;

a shaft element carried by said brush arm component head section and partially extending therefrom; said flexible shaft element being interconnected with said shaft element carried by said brush arm component head section to rotatably drive the same as said flexible shaft element is rotated by the operation of said motor; and a scrubbing element readily detachably interconnected with said shaft element carried by said brush arm component head section including a disk shaped body of scrubbing material adapted to be rotated by the operation of said motor.

2. The apparatus according to claim 1, wherein said brush arm component carried shaft element extending from said head section thereof is perpendicularly disposed with respect to the longitudinal axis of said hand grip section thereof.

3. The apparatus according to claim 2, wherein said brush arm component body section includes a first portion longitudinally aligned with said brush arm component hand grip section and a second portion disposed at an angle with respect to said first portion thereof.

4. The apparatus according to claim 3, wherein at least a portion of said housing upper wall slopes downwardly from the edge thereof substantially abutting said wall carrying said frame assembly towards said housing front wall.

* * * * *